United States Patent [19]

Rudy, Jr. et al.

[11] Patent Number: 4,752,248

[45] Date of Patent: Jun. 21, 1988

[54] POST PROTECTOR FOR WIRE WRAP POST TERMINALS

[75] Inventors: William J. Rudy, Jr., Annville; Howard R. Shaffer, Millersburg; Daniel E. Stahl, Dauphin, all of Pa.

[73] Assignee: AMP Incorporated, Harrisburg, Pa.

[21] Appl. No.: 42,418

[22] Filed: Apr. 24, 1987

[51] Int. Cl.[4] ..... H01R 9/15

[52] U.S. Cl. ..... 439/718; 361/428; 439/534; 439/709; 439/912

[58] Field of Search ..... 439/709, 713, 718, 724, 439/888, 55, 494, 78, 680, 681, 677, 679, 345, 347, 355, 357, 377, 622, 628, 633, 686, 660, 701, 725, 732, 49, 912, 534; 361/428

[56] References Cited

U.S. PATENT DOCUMENTS

| | | | |
|---|---|---|---|
| 3,399,374 | 8/1968 | Pauza et al. | 439/355 |
| 3,905,665 | 9/1975 | Lynch et al. | 339/17 L |
| 3,963,301 | 6/1976 | Stark | 439/680 |
| 4,168,877 | 9/1979 | Little et al. | 439/347 |
| 4,173,387 | 11/1979 | Zell | 339/196 M |
| 4,257,665 | 3/1981 | John et al. | 439/677 |

*Primary Examiner*—Neil Abrams

*Attorney, Agent, or Firm*—Anton P. Ness

[57] ABSTRACT

A dielectric protector (50) for an array of wire wrap posts (18) includes a transverse body section (52) having a like array of holes (56) therethrough corresponding to ends (22) of respective posts (18), with body section (52) just forwardly therefrom; holes (56) permit access to post ends (22) by test probes. Pairs of latch arms (70,80) extend to housing (12) from sides (72,82) of body section (52) having latching recesses (76,86) at outwardly deflectable free ends (74,84), which latch to latching projections (24,26) in channels (30,34) along sides (28,32) of housing (12). Gripping sections (78,88) extend in pairs outwardly of outer face (66) from integral hinge joints (90) joining latch arms (70,80) to body section (52) and are manually deflectable together to deflect free ends (74,84) outwardly and delatch post protector (50) from housing (12). Skirts (94,96) extend inwardly toward housing (12) around the periphery of the array of posts (18), and the post protector protects posts (18) from inadvertent damage or contact from debris, stray conductor wires or tools. The post protector may be adapted for polarization with housing (12) and include indicia (92) for identifying each of posts (18).

8 Claims, 6 Drawing Sheets

POST PROTECTOR FOR WIRE WRAP POST TERMINALS

FIELD OF THE INVENTION

This relates to the field of electrical connectors and more particularly to electrical connectors having arrays of terminal posts for wire wrapping.

BACKGROUND OF THE INVENTION

Electrical terminals are known which have elongated square post contact sections exposed so that a stripped end of a conductor wire can be wrapped tightly therearound by conventional apparatus. Mounting sections of the terminals may be secured in connector housings so that the wire wrap post contact sections thereof are arranged in a closely spaced array; and, the terminals have an array of contact sections at the other ends thereof to be mated to corresponding terminals of mating connectors. Such connectors having arrays of wire wrap posts can then be removably mounted to panels in modular fashion, or to printed circuit boards with the wire wrap posts extending through board holes in electrical engagement with conductive paths thereon.

It is desirable to provide a means for protecting the wrapped array of wire wrap posts from incidental damage from debris or tools and from incidental undesirable electrical engagement with stray conductor wires or metal debris.

It is further desirable to provide post protection which is removably securable about the post array so that the protection means may be removed when it is desired to obtain access to a selected one of the posts in the array such as for disconnecting a wrapped wire therefrom to replace the wire or to replace the terminal.

It is still further desirable to provide post protection which permits access to the end of each terminal post by probes of electrical testing apparatus to enable testing thereof.

It is yet further desirable to provide a means for identifying each of the posts in the array proximate their respective ends.

SUMMARY OF THE INVENTION

A dielectric post protector has a transverse body section containing an array of through holes larger than the cross-sectional dimension of the respective wire wrap posts with which they are associated, and each hole can be identified by indicia on the outer face of the body section. Skirt sections extend toward the connector from sides and ends of the body section for further post protection. Near each end of the body section a pair of opposed latch arms extend axially from sides of the body section with free ends having latching recesses therein, to be latched to latching projections along sides of a connector housing containing a plurality of terminals having wire wrap post contact sections. The latch arms have gripping sections extending outwardly from the outer face of the body section, in opposed pairs, so that by means of integral hinge joints with the body section the pairs of latch arms can have their latching free ends moved apart to unlatch the protector from the connector when the pairs of gripping sections are manually urged together.

According to another aspect of the invention, the latching free ends can be moved during latching along receiving channels along the sides of the connector housing containing the latching projections, and the protector can be polarized with respect to the connector by means of the free ends of the latch arms on one side being wider than those on the other side and thus not be received in narrower receiving channels designed for the narrower free ends. According to yet another aspect of the invention, a plurality of post protectors can be used in a closely spaced arrangement for several arrays, and to facilitate manipulation of the gripping sections those along each first side of each protector are angled in one direction while those along each second side of each protector are angled in the opposite direction minimizing interference by gripping sections of adjacent similar protectors.

It is an objective of the present invention to provide an integral dielectric member for protecting ends of an array of wire wrap post contact sections of terminals secured in a housing and wire wrapped, which is easily latchable and delatchable from the housing.

It is another objective for the post protector to allow individualized access by test probes to the ends of the wire wrap posts and to identify each post by indicia.

It is yet another objective for the post protector to be used in a closely spaced arrangement of like protectors and to be easily accessible for delatching and removal from the arrangement.

DETAILED DESCRIPTION OF THE PREFERRED EMBODIMENT

Figure 1:
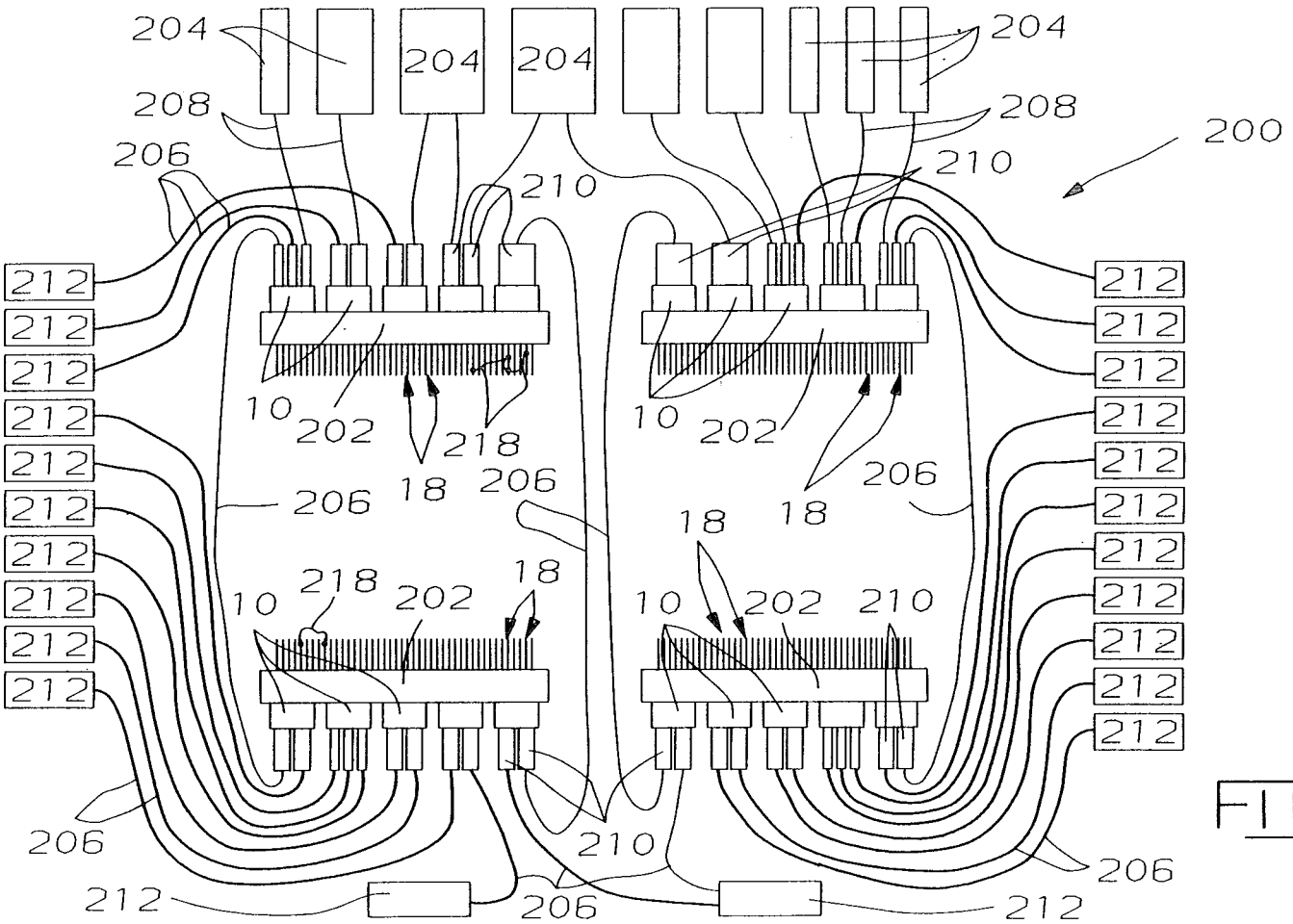
FIGS. 1 and 2 are schematic and perspective views of a wire integration system with which the present invention may be used.
Figure 2:
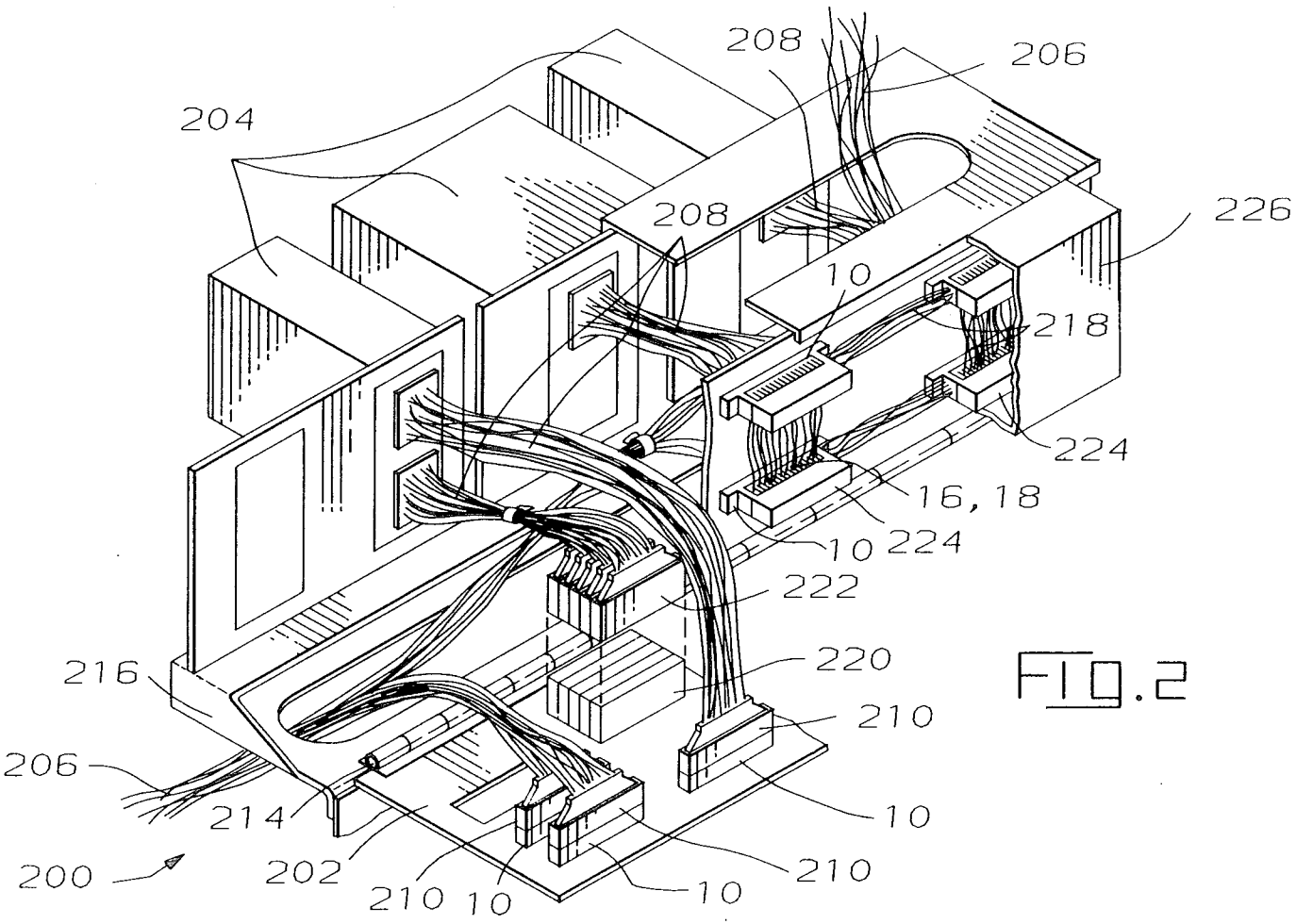

FIGS. 1 and 2 illustrate a wire integration system 200 such as for use on aircraft where a plurality of shipboard systems including power, control, detection, indication, radio reception and transmission and so on must be interconnected or "integrated" at one or more wire integration panels 202 with other such systems. Such systems must be capable of being controlled or sensed at a central location or electrical/electronics bay by a plurality of "black boxes" 204 and also be capable of being interconnected with each other as desired. The black boxes must be capable of removal from the aircraft such as for frequent routine testing and maintenance, or for replacement. Cables 206,208 generally are arranged in bundles or harnesses terminated at one end by modular plug connectors 210 which extend to a wire integration panel 202 on which are mounted receptacle connectors 10 matable at one face of the panel with plug connectors 210. Mating receptacle connectors 10 and plug connectors 210 are shown having two rows of terminals; a receptacle connector 220 and a plug connector 222 are shown ready to be mated and having five rows of terminals, for example, illustrating the modular capability of wire integration system 200.

Along the face of the panel opposed from the face receiving plug connectors 210, in the embodiment shown, terminals 16 of receptacle connectors 10 are secured in housings 12 and have exposed elongate wire wrap posts 18 extending outwardly therefrom for one or more electrical conductor wires 218 to be wrapped for electrical connection to corresponding one or more terminals of respective one or more electrical systems as desired. Preferably post protectors 224 are secured over the wire wrap arrays, and a cover member 226 is mounted to the panel for additional protection.

The other ends of cables 206 are electrically connected with shipboard systems 212 or another wire integration panel 202, while the other ends of cables 208 are electrically connected to black boxes 204. The mating plug and receptacle connector assemblies 210,10 must be modular and panel mountable; be uniquely keyed; be easily latchable upon mating in an aligned, keyed and polarized manner; and be easily delatchable. Integration panel 202 can have receptacle connectors 10 mounted thereto and automatically or semi-automatically wired as a total subassembly and tested prior to installation into the aircraft, and also can be removed from the aircraft for testing, repair or replacement if necessary. Panel 202 is hinged at hinge 214 to be lowered forwardly from a supporting structure 216 for easy access to the rearward face of the panel. This access facilitates programming and reprogramming which is essential in order to adapt an aircraft of otherwise standard manufacture to meet the avionic requirements of specific customer airlines.

Figure 3:
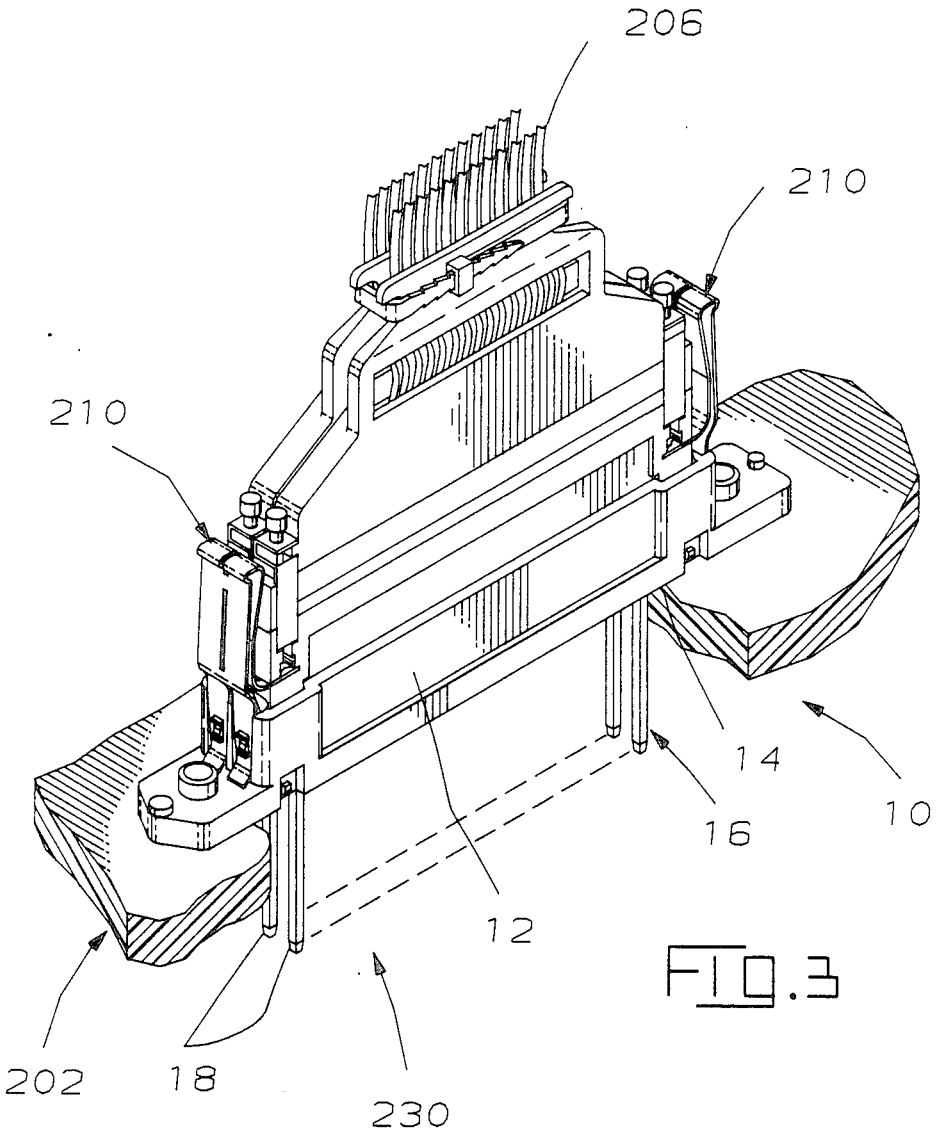
FIG. 3 is a perspective view of mated plug and receptacle connectors for use on a wire integration panel of the system of FIGS. 1 and 2.

FIG. 3 shows a two-row plug connector 210 to mate with the mating face of a two-row receptacle connector 10 mounted to integration panel 202 of FIG. 2, with an array of wire wrap posts 18 of terminals 16 extending from a wire wrap face 14 of the receptacle connector 10. Such a mating connector system 230 for the wire integration system 200 of FIGS. 1 and 2 is described with more particularity in U.S. patent application Ser. Nos. 042,205; 042,495; 042,201; 042,203; and 042,084 all filed Apr. 24, 1987 and all assigned to the assignee hereof.

Figure 4:
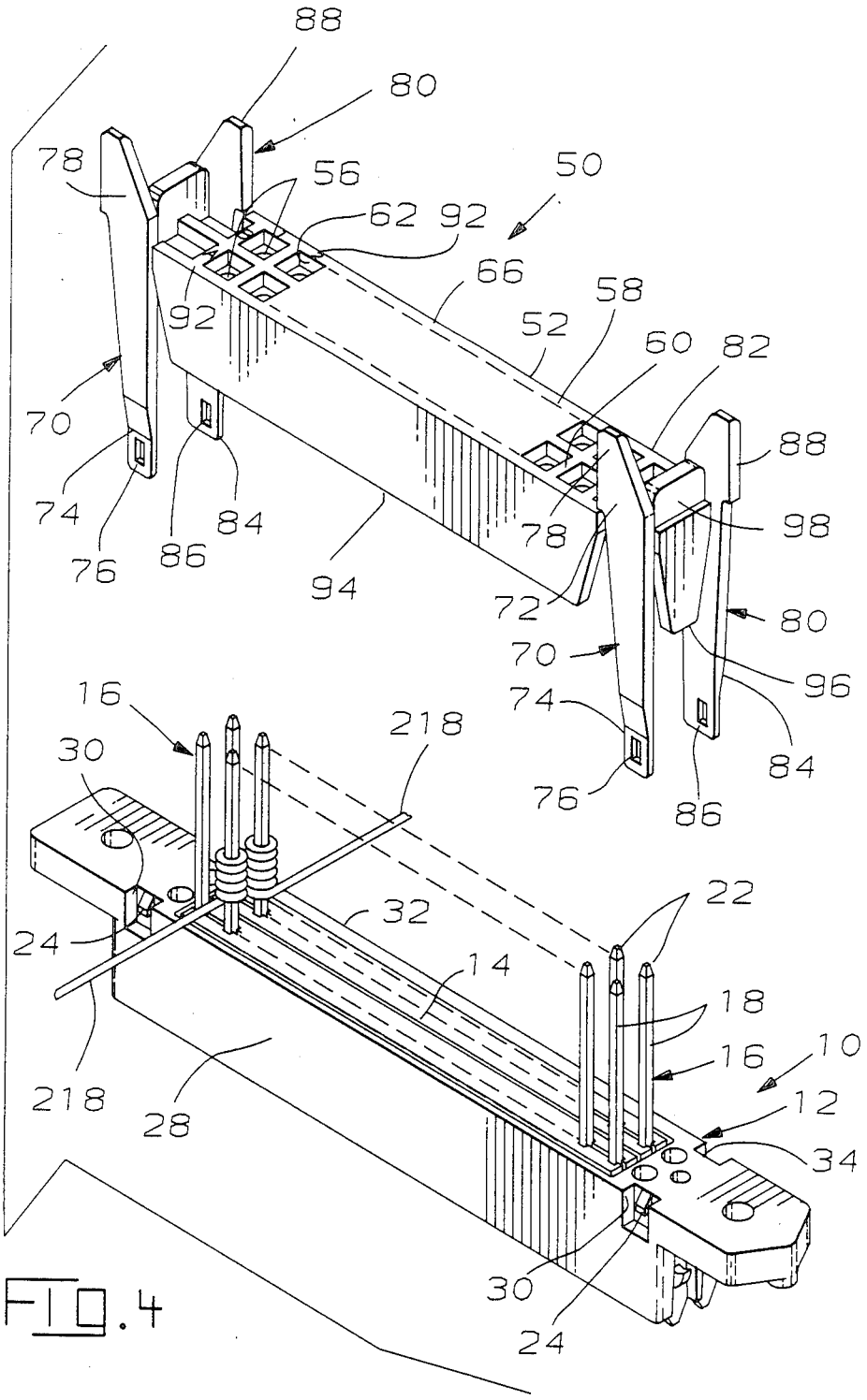
FIG. 4 is a perspective view of a two-row connector having an array of wire wrap posts, and a two-row post protector exploded therefrom.
Figure 5:
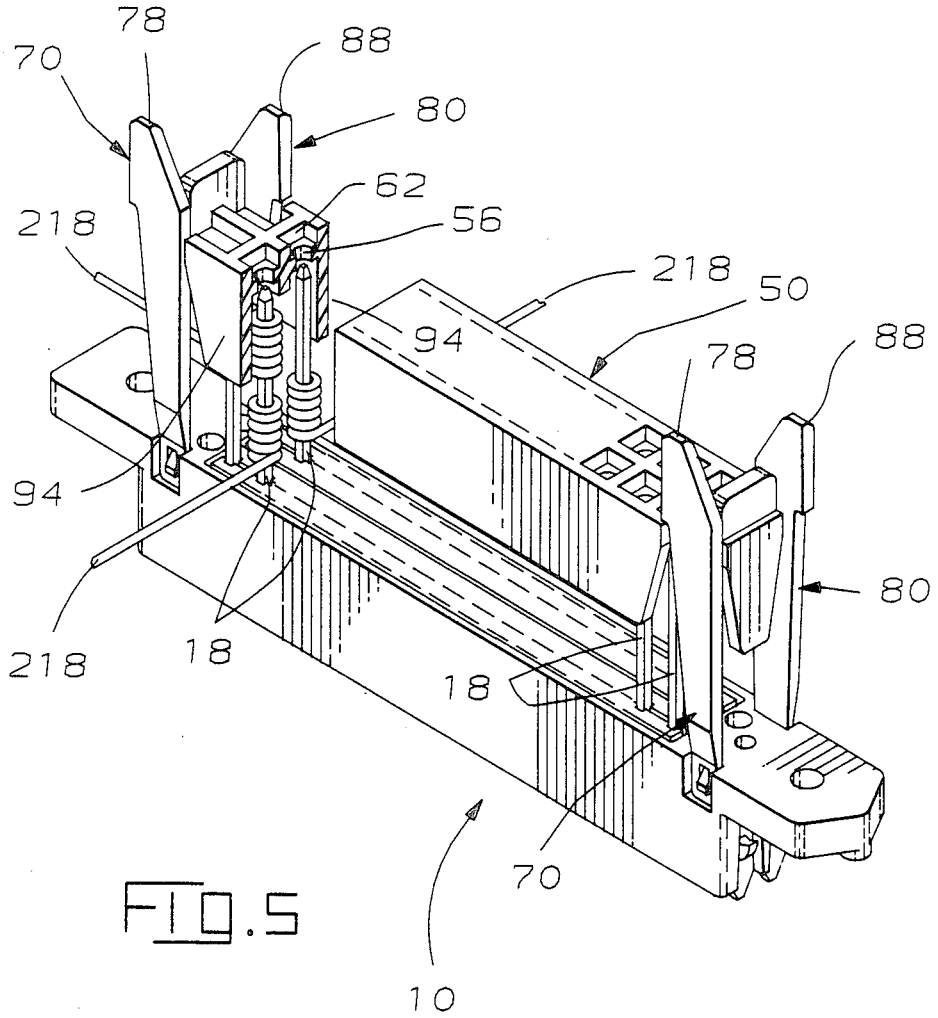
FIG. 5 is an assembled perspective view of the connector and post protector of FIG. 4 with part of the protector broken away displaying the post ends, and representative wires wrapped onto a post.

A post protector 50 of the present invention is shown in FIGS. 4 and 5 which is latchably securable to housing 12 of receptacle connector 10 along wire wrap face 14 to protect the array of wire wrap post sections 18 of terminals 16. Post protector 50 is molded of dielectric material such as of thermoplastic resin, preferably glass-filled polyetherimide, and comprises preferably an integral member. Transverse body section 52 will be disposed just forwardly of terminal ends 22 and preferably includes a thin central plate 54 (FIG. 6A) containing an array of circular holes 56 each corresponding to a respective terminal end 22. With reference to FIGS. 4 and 5 and also FIGS. 6A and 6B, orthogonal intersecting barrier walls 58,60 extend both outwardly from and inwardly from central plate 54 and strengthen the central plate while defining larger square cavities 62,64 outwardly from each hole 56 to outer face 66 and inwardly from each hole 56 to inner face 68 (except the holes at each end of both rows of holes 56, or at each end of the outer rows in a protector having more than two rows of holes for a post array having more than two rows of posts).

First arms 70 extend normally from first side 72 of post protector 50 to latching free ends 74 inwardly from inner face 68 (FIG. 6A) and having latching recesses 76 therein. First arms 70 also include gripping sections 78 extending normally from first side 72 in the other direction outwardly from outer face 66. Similarly, second arms 80 extend normally from second side 82 to latching free ends 84 having latching recesses 86, and also include gripping sections 88 outwardly from outer face 66, essentially in paired relationship with first arms 70. Arms 70,80 are joined to respective sides 72,82 (FIG. 6A) preferably at integral stiff hinge joints 90 (FIGS. 6A and 6B) which cause limited deflection of latching free ends 74,84 of each pair outwardly relatively from each other when gripping section 78,88 of each pair are urged inwardly relatively toward each other.

Figure 6A:
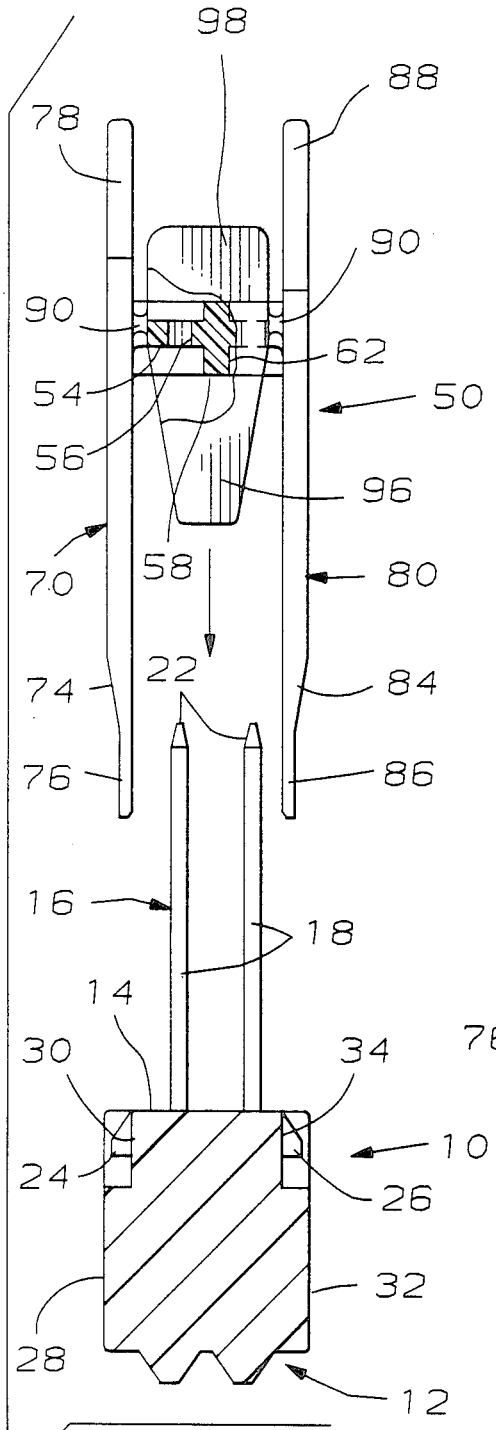
FIGS. 6A and 6B are end views showing the post protector being assembled to a connector.
Figure 6B:
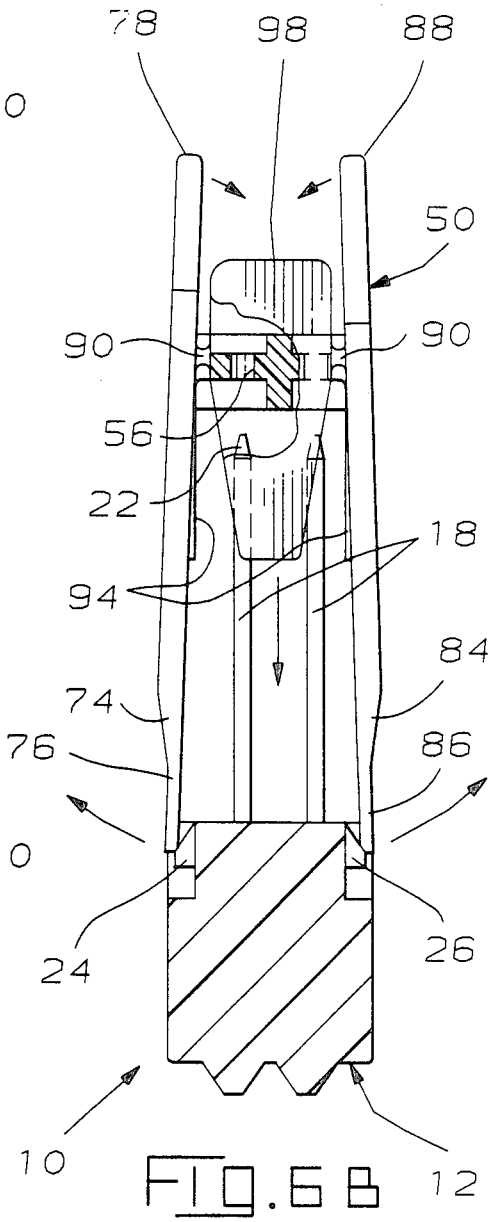

Referring to FIGS. 4, 6A and 6B, post protector is latchable to connector housing 12 by latching recesses 76,86 of free ends 74,84 of arms 70,80 being latchingly engaged by respective latching projections 24,26 of housing 12. Preferably latching projections 24 along a first housing side 28 are disposed along channels 30 for receiving free ends 74 of arms 70, with channels 30 and free ends 74 being relatively narrow; while latching projections 26 along a second housing side 32 are disposed along channels 34 for receiving free ends 84 of arms 80, with channels 34 and free ends 84 being relatively wide. With this preferred arrangement, post protector 50 is polarized with respect to connector housing 12 and can be latched thereto in only one orientation. Such polarization enables outer face 66 of body section 52 to include alphanumeric or other appropriate indicia 92 (FIG. 4) identifying each hole 56 and also each terminal end 22 associated therewith.

Post protector 50 is preferably constructed in a manner permitting a closely spaced arrangement of a plurality of such protectors to protect a similarly closely spaced arrangement of receptacle connectors 10 having arrays of wire wrap posts 18. First gripping sections 78 along first side 72 of body section 52 are preferably angled to one side, parallel to first side 72, while second gripping sections 88 along second side 82 are preferably angled in the other direction, as can be discerned in FIGS. 4 and 5. This offsetting arrangement of gripping sections facilitates manual engagement and actuation of the pairs of gripping sections of a selected post protector between adjacent post protectors having similarly offset first and second gripping sections, by minimizing interference by the structure of the adjacent gripping sections with manual engagement.

Post protector 50 also preferably includes side skirts 94 extending inwardly from first and second sides 72,82 and end skirts 96 extending inwardly from respective ends of body section 52, to provide additional protection to the array of post contact sections 18 from incidental contact by debris or stray conductor wires, or by tools during repair, maintenance or testing. Conductor wires 218 wrapped to posts 18 extend outwardly from the connector assembly between connector housing 12 and skirts 94,96. Also, preferably, end skirts 96 include tab sections 98 extending outwardly from outer face 66 between respective pairs of gripping sections 78,88 and are dimensioned to stop overdeflection inwardly of the pairs of gripping sections 78,88 during delatching.

Modifications may occur to the post protector of the present invention for adapting to specialized situations or types of mounting means other than a connector like connector 10 and especially other latching arrangements may be used, or one or three or more rows of holes formed in the body section for a like number of rows in a post array. Such modifications would be within the spirit of the invention and the scope of the claims.

We claim:

1. A post protector for protecting an array of exposed elongate post contact sections of a plurality of terminals secured in a mounting means, where the post contact sections coextend axially outwardly to ends thereof from a face of the terminal mounting means and are electrically connected to respective conductors wrapped therearound, comprising:

a dielectric member including a body section having opposed sides and opposed ends and an outer face and an opposed inner face;

elongate means spacing said body section just forwardly of the ends of wire wrap post contact sections of the plurality of terminals extending from a face of said terminal mounting means and transverse to the axes of the wire wrap post contact sections;

means included on outer ends of said spacing means for securing said dielectric member to a terminal mounting means, said securing means adapted to secure said dielectric member to said terminal mounting means after post contact sections of the terminals thereof have been wire wrapped; and an array of holes through said body section corresponding to said ends of said post contact sections permitting access to said wire wrap post contact sections by test probes, whereby said dielectric member is securable about a wrapped array of post contact sections whereafter said ends of said exposed elongate post contact sections are physically protected from inadvertent engagement by foreign objects in a manner permitting electrical testing thereof from forwardly thereof.

2. A post protector as set forth in claim 1 wherein said body section includes a thin transverse central portion containing substantially all of said array of holes, said thin central portion strengthened by orthogonal intersecting walls between ones of said holes integrally joined to said thin central portion, said intersecting walls extending to said inner face and said outer face of said body section.

3. A post protector as set forth in claim 1 wherein said spacing means comprise opposing pairs of first and second arms integrally joined to said body section proximatecorners of said body section peripherally of said array of holes and extending forwardly therefrom a distance about equal to the length of the post contact sections to free ends, and said securing means comprise said inner free ends of said first and second arms each including a latching recess cooperable with a respective one of latching projections on opposing sides of said terminal mounting means, whereby said dielectric member is latchably securable to said terminal mounting means when said arm free ends latch thereto.

4. A post protector as set forth in claim 3 wherein said first arms extend from respective integral stiff hinge joints along a common first side of said body section proximate respective said ends and said second arms extend from respective integral stiff hinge joints along a common second side of said body section proximate respective said ends, each said first arm includes a first gripping section and each said second arm includes a second gripping section, and said first and second gripping sections extend rearwardly from said outer face of said body section in opposed facing pairs and are deflectable towards each other during removal of said dielectric member from said terminal mounting means causing said inner free ends of said first and second arms to be deflected outwardly away from said sides of said terminal mounting means disengaging from said latching projections resulting in delatching.

5. A post protector as set forth in claim 4 wherein said first gripping sections of said first arms extend parallel to said first side and at a selected common first angle, and said second gripping sections of said second arms extend parallel to said second side and at a selected common second angle in a direction opposed to that of said first angle, whereby gripping of said gripping sections of said dielectric member is facilitated when said dielectric member is disposed in a closely spaced array of like dielectric members secured to the terminal mounting means by reason of said first gripping sections extending away from second gripping sections of an adjacent like dielectric member, and said second gripping sections extending away from first gripping sections of another adjacent like dielectric member.

6. A post protector as set forth in claim 3 wherein said inner free ends of said first and second arms are adapted to extend along respective axial channels along said opposing first and second sides of said terminal mounting means containing said latching projections and free ends of said second arms are wider than free ends of said first arms to extend along correspondingly wider ones of said channels on said second side of said terminal mounting means said dielectric member is properly oriented with respect to said mounting means, providing means for polarizing said post protector with respect to said mounting means.

7. A post protector as set forth in claim 4 wherein said dielectric member includes sections extending rearwardly from said body member and between said first and second gripping sections of each said pair of said first and second arms, said sections being dimensioned to provide stop surfaces spaced inwardly a selected distance from said first and second gripping sections to allow inward deflection thereof and to prevent overdeflection of said first and second gripping sections upon manual deflection thereof toward each other during removal of said dielectric member from said terminal mounting means.

8. In combination, a wrapped array of elongate wire wrap post contact sections mounted in a mounting means and extending from a face thereof, and a post protector thereover, comprising:

an array of terminals secured in a mounting means and including exposed elongate post contact sections coextending axially outwardly to ends thereof from a face of the terminal mounting means and electrically connected to respective conductors wrapped therearound;

a dielectric member including a body section having opposed sides and opposed ends and an outer face and an opposed inner face;

elongate means spacing said body section just forwardly of said ends of said post contact sections of said terminals extending from said face of said terminal mounting means and transverse to the axes of said post contact sections;

means included on outer ends of said spacing means for securing said dielectric member to said terminal mounting means, said securing means adapted to secure said dielectric member to said terminal mounting means after post contact sections of the terminals thereof have been wire wrapped; and an array of holes through said body section corresponding to said ends of said post contact sections permitting access to said wire wrap post contact sections by test probes, whereby said dielectric member is secured about a wrapped array of post contact sections whereafter said ends of said exposed elongate post contact sections are physically protected from inadvertent engagement by foreign objects in a manner permitting electrical testing thereof from forwardly thereof.

* * * * *